US006289537B1

(12) United States Patent
Hopper et al.

(10) Patent No.: US 6,289,537 B1
(45) Date of Patent: Sep. 18, 2001

(54) PATIENT SUPPORT

(75) Inventors: Christopher J. Hopper, Kalamazoo; Stanley Palmatier, Paw Paw; Jeffrey C. Shiery, East Leroy; Jerry Wheeler, Mattawan; Rick McDaniel, Constantine, all of MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 09/501,336

(22) Filed: Feb. 9, 2000

(51) Int. Cl.[7] ..... A61G 13/00; A61G 13/12; A47G 20/04

(52) U.S. Cl. ..... 5/624; 5/602; 5/618; 5/648

(58) Field of Search ..... 5/624, 602, 621, 5/648, 651, 618

(56) References Cited

U.S. PATENT DOCUMENTS

| | | | | |
|---|---|---|---|---|
| Re. 21,972 | * | 12/1941 | Demcak | 5/618 |
| D. 282,398 | | 1/1986 | Yindra | D24/184 |
| 1,607,168 | * | 11/1926 | Murphy | 5/602 |
| 2,177,341 | * | 10/1939 | Demcak | 5/618 |
| 2,223,784 | | 12/1940 | Froelich | 5/624 |
| 2,679,445 | * | 5/1954 | Roehm | 5/624 X |
| 2,714,541 | * | 8/1955 | Reichert et al. | 5/624 |
| 3,833,211 | | 9/1974 | Mueller et al. | 5/624 |
| 3,944,205 | | 3/1976 | Mueller | 5/624 |
| 4,046,365 | | 9/1977 | Dungan | 5/649 |
| 4,225,127 | * | 9/1980 | Strutton | 5/602 |
| 4,270,233 | * | 6/1981 | Mulligan | 5/602 |
| 4,360,193 | | 11/1982 | Mitchell | 5/649 |
| 4,407,687 | | 10/1983 | Mitchell | 156/227 |
| 4,958,816 | * | 9/1990 | Chaney et al. | 5/624 |
| 5,214,812 | * | 6/1993 | Bartow et al. | 5/624 |
| 5,560,577 | | 10/1996 | Keselman | 5/624 X |
| 5,582,379 | * | 12/1996 | Keselman et al. | 5/624 X |
| 5,802,641 | | 9/1998 | Van Steenburg | 5/648 |
| 5,803,088 | | 9/1998 | Blackwell | 128/882 |
| 5,918,330 | * | 7/1999 | Navarro et al. | 5/624 |

* cited by examiner

*Primary Examiner*—Michael F. Trettel
*Assistant Examiner*—Robert G. Santos
(74) *Attorney, Agent, or Firm*—Flynn, Thiel, Boutell & Tanis, P.C.

(57) ABSTRACT

A patient support having a frame supporting a patient supporting surface as well as supporting a pair of foot rest mechanisms thereon. The pair of foot rest mechanisms are each selectively movable from stowed positions beneath the patient supporting surface to deployed positions thereof which straddle a drop leaf foot section forming a part of the patient supporting surface. As the drop-leaf foot section is moved to a vertically upright position, a space between the two foot rest mechanisms is available for physician use. Further, as the drop leaf foot section is moved in the vertically upright position toward the floor, a mechanism is provided for preventing contact of the foot end of the drop leaf foot section with the floor.

26 Claims, 12 Drawing Sheets

PATIENT SUPPORT

FIELD OF THE INVENTION

This invention relates to a patient support and, more particularly, to a patient support having a patient supporting surface thereon with a drop leaf foot section straddled by a pair of foot rest mechanisms.

BACKGROUND OF THE INVENTION

Patient supports are, of course, very well known in the art. A multitude of styles have been developed over the years to accommodate the needs of the medical profession. One such need relates to the obstetrics and gynecological field of medical practice and, more particularly, to the needs of the physician to access the pelvic region of the patient for examination purposes. Oftentimes the physical construction of the patient support gets in the way of such examinations and the foot supports are not always conveniently available for deployment by the physician.

Accordingly, it is an object of this invention to provide a patient support having a pair of selectively longitudinally deployable foot supports conveniently stored underneath the patient support surface, but yet readily accessible by the physician for deployment and patient use.

It is a further object of the invention to provide a patient support, as aforesaid, wherein the foot supports are each laterally shiftable toward and away from each other to facilitate patient comfort.

It is a further object of the invention to provide a patient support, as aforesaid, wherein the foot supports are sturdy and durable and require a minimum of maintenance.

It is a further object of the invention to provide a patient support, as aforesaid, wherein the foot support includes a foot receiving platform having a surface configured to the bottom surface of a typical patient's foot, the platform being yieldably supported to facilitate flexure of the patient's foot.

It is a further object of the invention to provide a patient support, as aforesaid, which additionally includes an elevating mechanism for raising and lowering the patient support surface relative to a base, the patient support surface having a drop leaf foot section configured to move to a vertically upright position leaving the space between the pair of foot rests open for physician access to the pelvic region of the patient.

It is a further object of the invention to provide a patient support, as aforesaid, wherein the drop leaf foot section includes a mechanism for preventing the foot end of the drop leaf foot section from engaging the floor surface on which the patient support device is supported when the patient surface is lowered with respect to the base.

SUMMARY OF THE INVENTION

The objects and purposes of the invention are met by providing a patient support having a frame with a patient supporting surface thereon and a pair of foot rest mechanisms. Each of the foot rest mechanisms include a bearing housing oriented on the frame with a hollow sleeve being swivelably mounted to the bearing housing and facilitating movement of the hollow sleeve side to side and up and down. The hollow sleeve has a guideway extending therethrough. An elongate rod is slidably received in the guideway and is movable with respect to the hollow sleeve longitudinally between a first retracted position and a second extended position with respect to the patient support surface and is fixable at any position between the first and second positions. A foot support is secured to a first end of the elongate rod. The foot support has a manually engageable section thereon for facilitating the application of a selective manual force thereto for effecting at least one of the longitudinal movement, the side to side movement and the up and down movement of the elongate rod. A locking device is provided and is responsive solely to the weight applied by the patient's foot to the foot support for fixing the position of the elongate rod and, consequently, the foot support thereon relative to the patient support surface.

The objects and purposes of the invention are further met by providing a patient support having a frame with a patient supporting surface thereon. The patient support also includes a base and fluid operated jacks for interconnecting the base and the frame. The fluid operated jacks are configured for raising and lowering the frame relative to the base. A drop leaf foot section is pivotally supported on the frame for movement between a first generally horizontally aligned position and a second vertically aligned position. A cam mechanism is oriented between the drop leaf foot section and the base for pivoting the drop leaf foot section, when in a second position thereof, in response to a vertical downward movement of the frame so as to prevent contact of the drop leaf foot section with a surface upon which the patient support is resting.

The objects and purposes of the invention are further met by providing a foot support having an annular frame, a cross member connected to the annular frame and dividing it into a toe section and a heel section and a foot receiving tray secured to the cross member. The foot receiving tray has a spring steel core encased in a contoured platform which has a heel receiving section and a toe receiving section interconnected by a contoured surface. The spring steel core and the contoured platform are secured to the cross member and configured to flex to accommodate flexure of the patient's foot.

BRIEF DESCRIPTION OF THE DRAWINGS

Other objects and purposes of this invention will be apparent to persons acquainted with patient supports of this general type upon reading the following specification and inspecting the accompanying drawings, in which.

DETAILED DESCRIPTION

Figure 1:
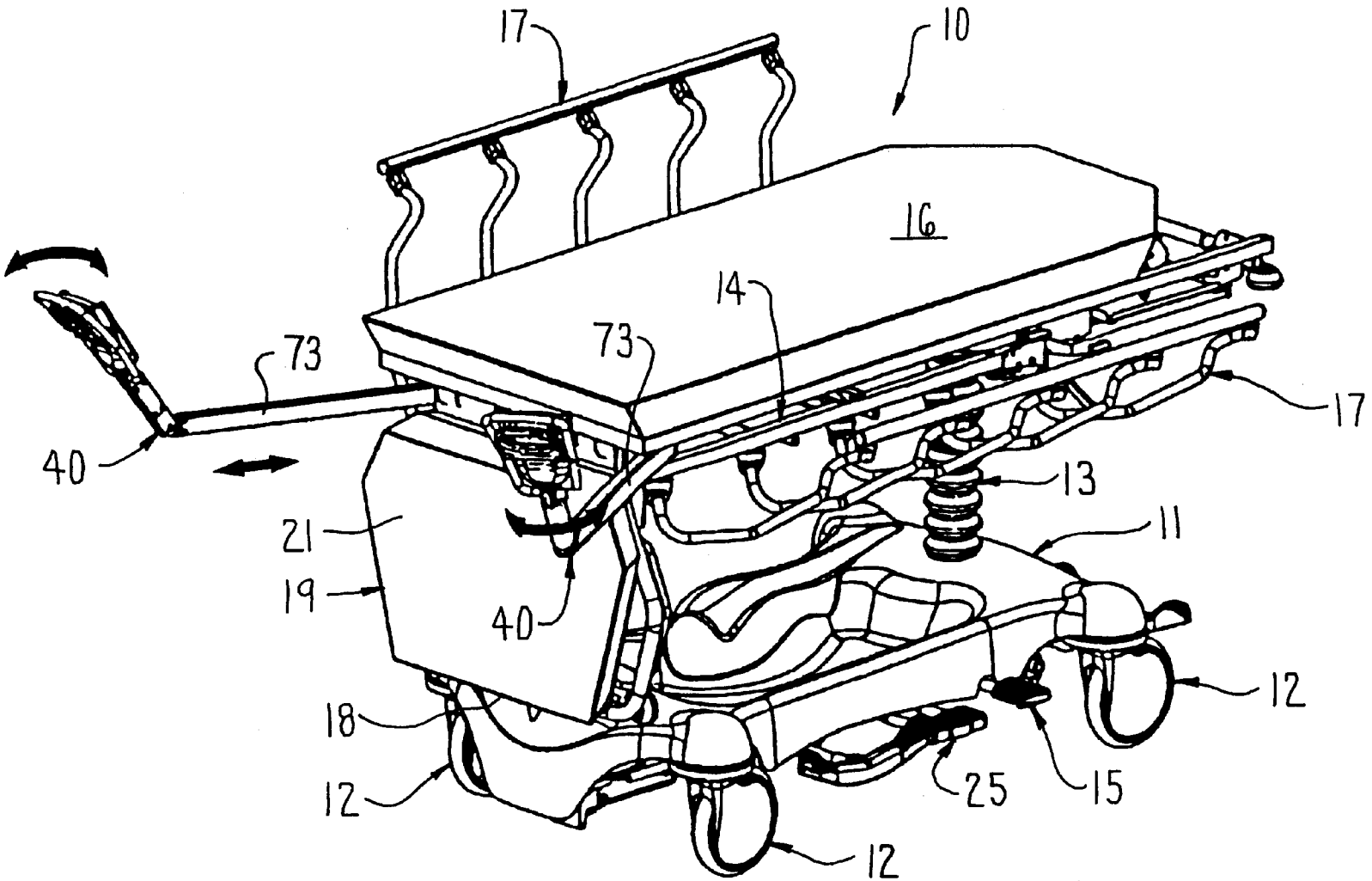
FIG. 1 is an isometric view of a patient support embodying the invention.

Certain terminology will be used in the following description for convenience in reference only and will not be limiting. The words "up", "down", "right" and "left" will designate directions in the drawings to which reference is made. The words "in" and "out" will refer to directions toward and away from, respectively, the geometric center of the device and designated parts thereof. Such terminology will include derivatives and words of similar import.

As illustrated in FIG. 1, a patient support 10 is configured as a stretcher or gurney and has a base frame 11 supported by a plurality of rotatable wheels 12 swivelable about vertical axes. A pair of vertically upright fluid operated jacks 13 are provided (only one of which is illustrated in FIG. 1) on an upper surface of the base frame 11 at opposite longitudinal ends thereof. Each of the jacks 13 is responsive to a pumping action generated by an attendant's application of force to a selected foot pedal 15 on the base frame 11. A pedal system for controlling the jacks 13 is described in detail in pending U.S. application Ser. No. 09/340 215, filed on Jun. 25, 1999, the disclosure of which is to be incorporated herein by reference. The upper end of each jack includes a vertically reciprocal rod 24 (not illustrated in FIG. 1, but see FIGS. 9–12) that extends from the upper end of the jack and is connected to a patient supporting member 14 having a mattress support 20, shown in FIG. 9 on which is provided a mattress 16. Side rails 17 are mounted to the patient support member 14 along the longitudinal edges thereof and are movable from a stowed position illustrated on the right side of FIG. 1 to a deployed position illustrated on the left side of FIG. 1. The side rail construction can be of any conveniently available type, such as the side rail configuration illustrated in U.S. Pat. No. 5,187,824.

Figure 9:
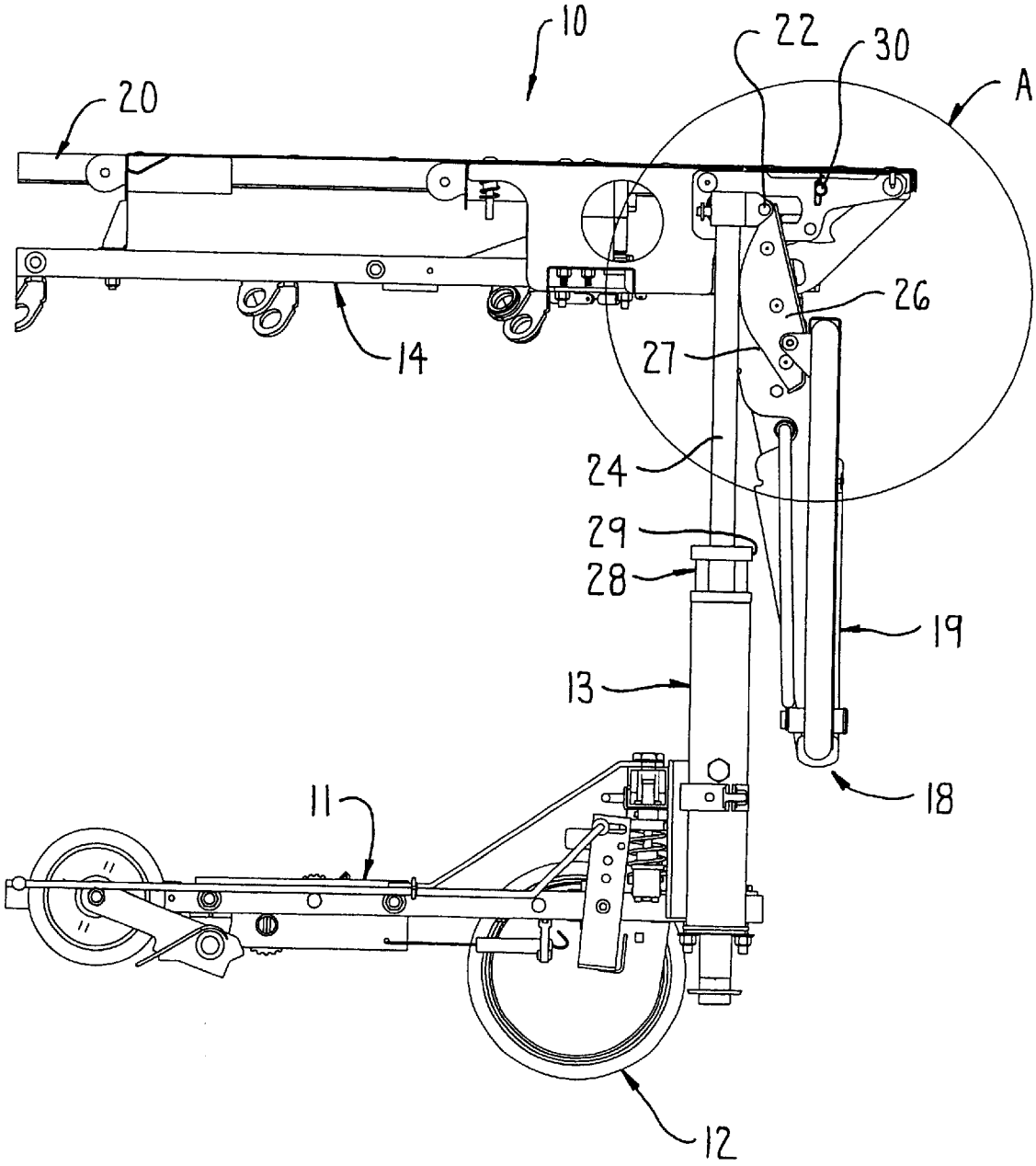
FIG. 9 is a side elevational view of a foot end of the patient support and a drop leaf section thereat.
Figure 10:
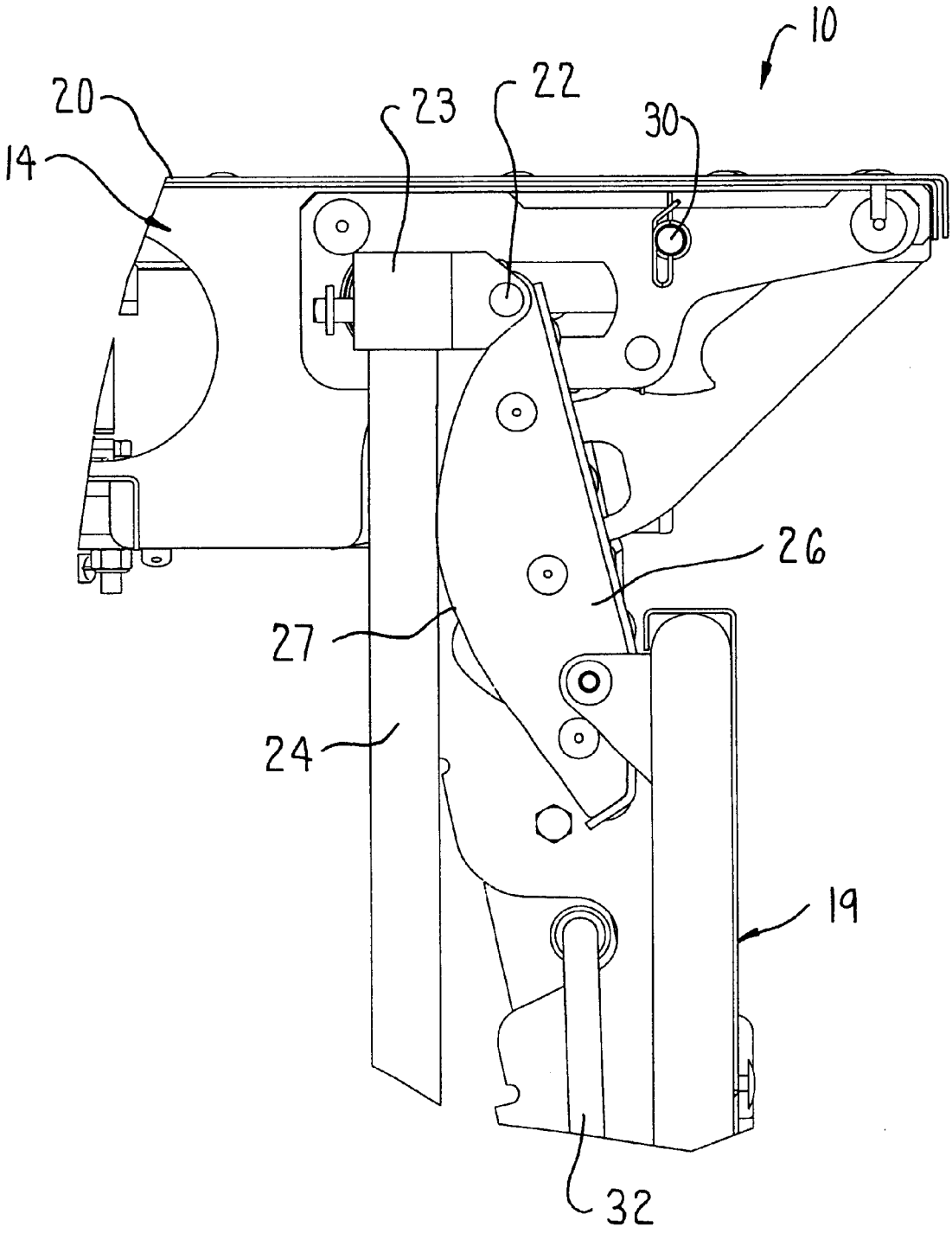
FIG. 10 is an enlarged fragment of the encircled region "A" of FIG. 9.
Figure 11:
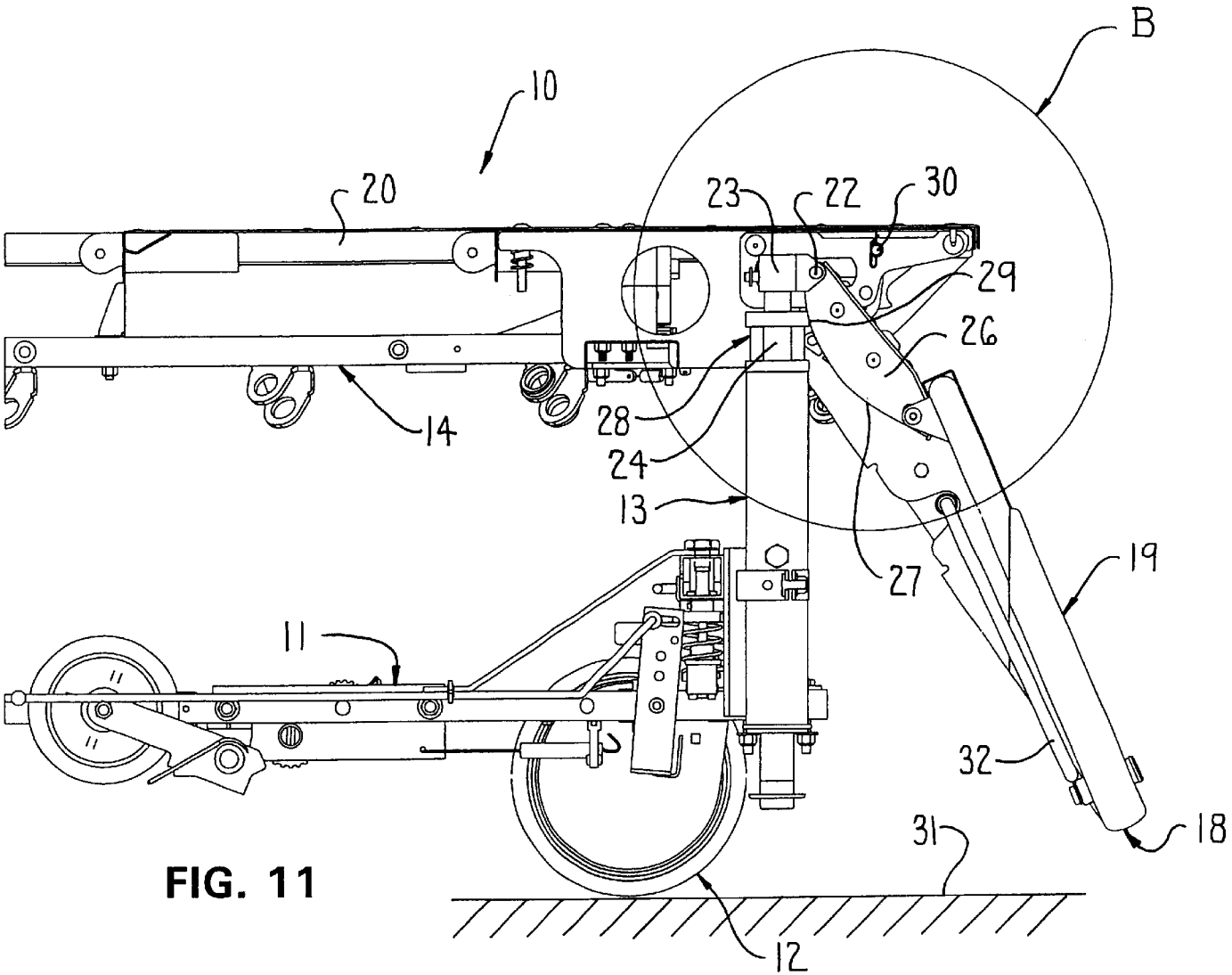
FIG. 11 is a side elevational view of a patient support, similar to FIG. 10, but with the drop leaf foot section being pivoted to a position so as to avoid contact with the floor.
Figure 12:
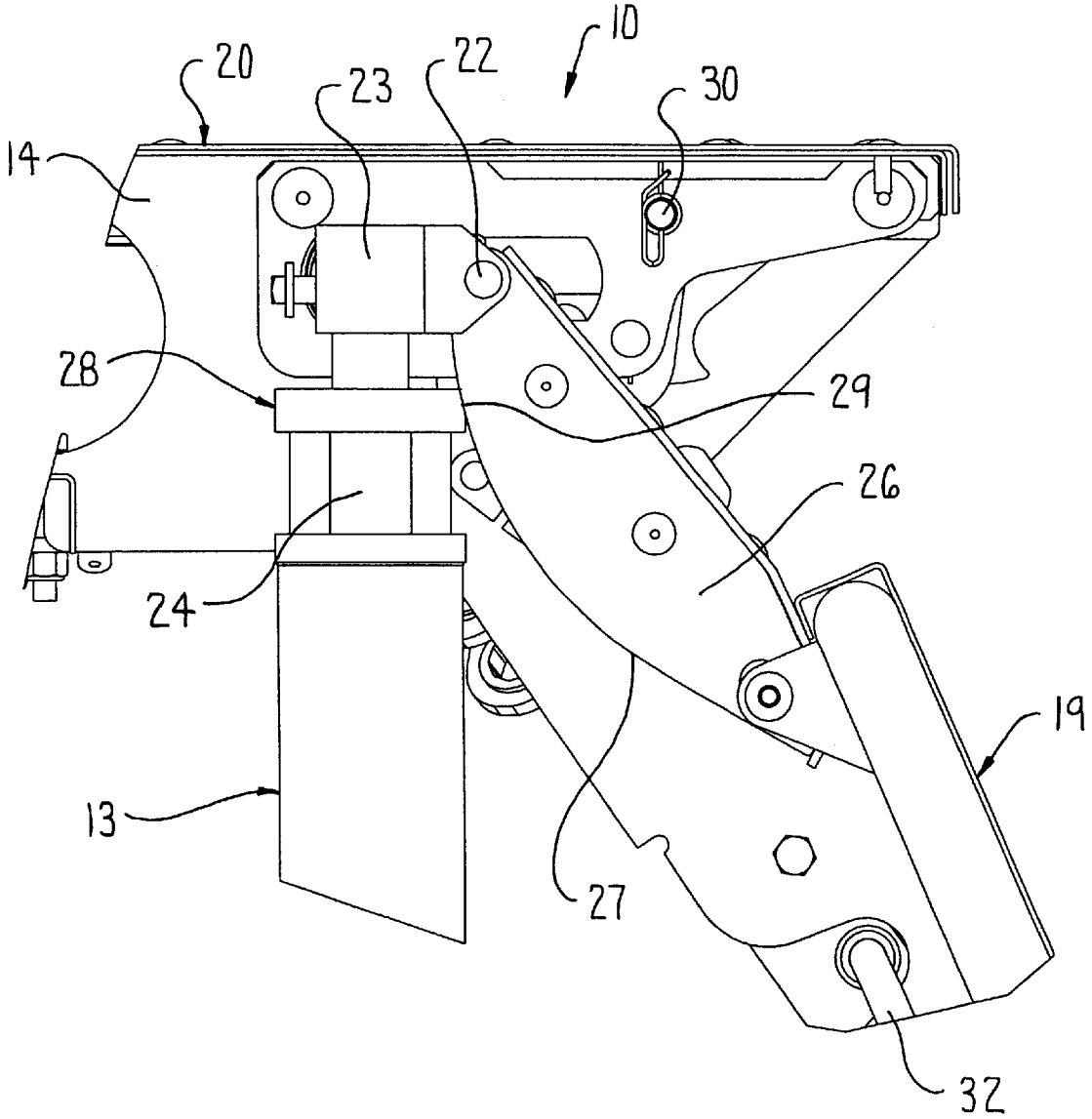
FIG. 12 is an enlarged fragment of the encircled region "B" of FIG. 11.

The patient support member 14 has at one end thereof, namely, at the foot end 18, a drop leaf section 19. The drop leaf section also includes a mattress support and a mattress 21 thereon which, when the drop leaf section 19 is elevated to a horizontally aligned position, is generally coplanar with the mattress 16. The drop leaf section is also illustrated in more detail in FIGS. 9–12. Furthermore, the jack 13 at the foot end of the base frame 11 and which is not illustrated in FIG. 1 is illustrated in FIGS. 9 and 11. The drop leaf section 19 is pivotally secured to the patient support member 14 about an axis of an axle 30 illustrated in FIGS. 9–12. A bracket 23 is fixed to the reciprocal rod 24 of the jack 13. A cam 26 is pivotally connected to an axle 22 on the bracket 23 and is configured to pivot into engagement with the underside of the drop leaf section 19. The cam 26 has an arcuate surface 27 thereon. In this particular embodiment, and when the drop leaf section 19 is in a vertically upright position, such as is illustrated in FIGS. 9 and 10, drop leaf section 19 rests against the cam 26 and the cam surface 27 rests against the outer surface of the rod 24 to thereby limit the clockwise movement of the drop leaf section 19 about the axis of the axle 30. Further, the upper end of the jack 13 includes a stop 28 having a surface 29 thereon. When the fluid to the jacks 13 is removed by depressing another one of the pedals 25 of the pedal system on the base frame 11, the patient support member 14 and the attached drop leaf section 19 will move toward the floor 31 (FIG. 11). In order to prevent the foot end 18 of the drop leaf section 19 from engaging the floor surface 31, the surface 29 of the stop 28 is configured to engage the cam surface 27 of the cam 26 to effect a pivotal movement of the drop leaf section 19 in a counterclockwise direction about the axis of the axle 30. A comparison of FIGS. 9 and 11 as well as 10 and 12 will make it abundantly clear that the operative engagement between the cam surface 27 and the surface 29 on the stop 28 effect the aforesaid counterclockwise movement of the drop leaf section 19 to the position illustrated in FIG. 11 corresponding to the lowermost position of the patient support member 14 relative to the surface of the floor 31.

In order to support the drop leaf section 19 in a horizontal position generally aligned with the patient support member 14, a conventional latching system (not illustrated) is provided, which latching system is releasable by activation of a manually engageable handle 32.

As is illustrated in FIG. 1, the patient support 10 also includes a pair of foot rest mechanisms 40 oriented on opposite longitudinal sides of the patient support member 14 and the drop leaf section 19. Each foot rest mechanism 40 is a mirror image of the other and, therefore, only one such foot rest mechanism will be described in reference to FIGS. 2–8.

Figure 2:
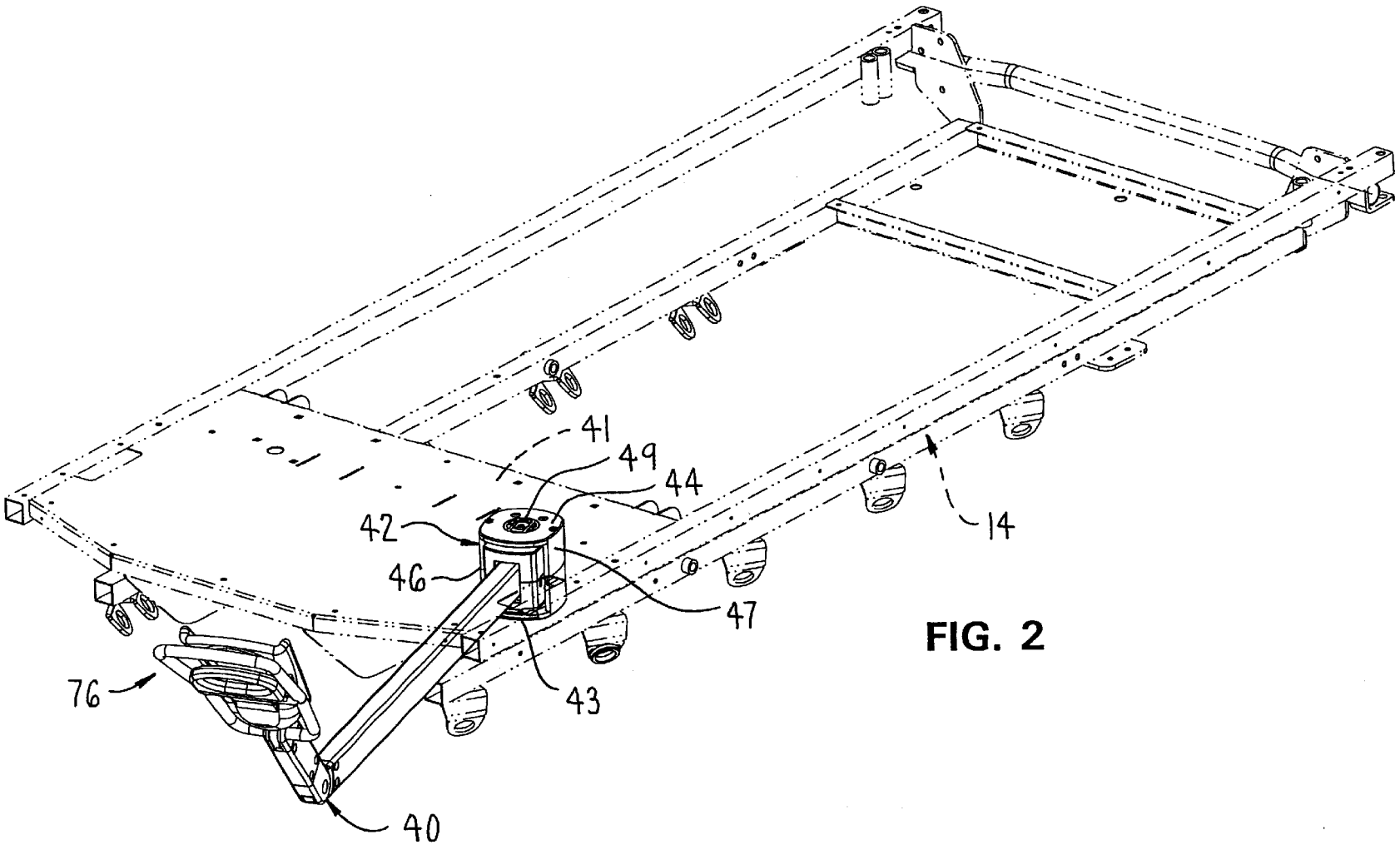
FIG. 2 is an isometric view of a fragment of the patient support, namely, that region beneath the patient supporting surface.

Referring now to FIG. 2, the patient support member 14 includes at the foot end thereof a horizontally oriented plate 41 on which is mounted a bearing housing 42 oriented adjacent one of the longitudinal edges of the patient support member 14. The bearing housing 42 is anchored to the plate 41 by any conventional fastening means such as screws (not illustrated). In FIG. 2, the left bearing housing 42 for the foot rest mechanism 40 on the left side of FIG. 1 is not illustrated.

The bearing housing 42 includes a base wall 43 (FIG. 4), a top wall 44 and interconnecting and laterally spaced sidewalls 46 and 47 interconnecting the base wall 43 and the top wall 44. An opening 48 is provided in the base wall 43. A similar opening 49 is provided in the top wall 44, the openings 48 and 49 being coaxially aligned with one another. The vertical spacing between the base wall 43 and the top wall 44 as well as the lateral spacing between the sidewalls 46 and 47 define the interior region 51 of the bearing housing 42.

Figure 7:
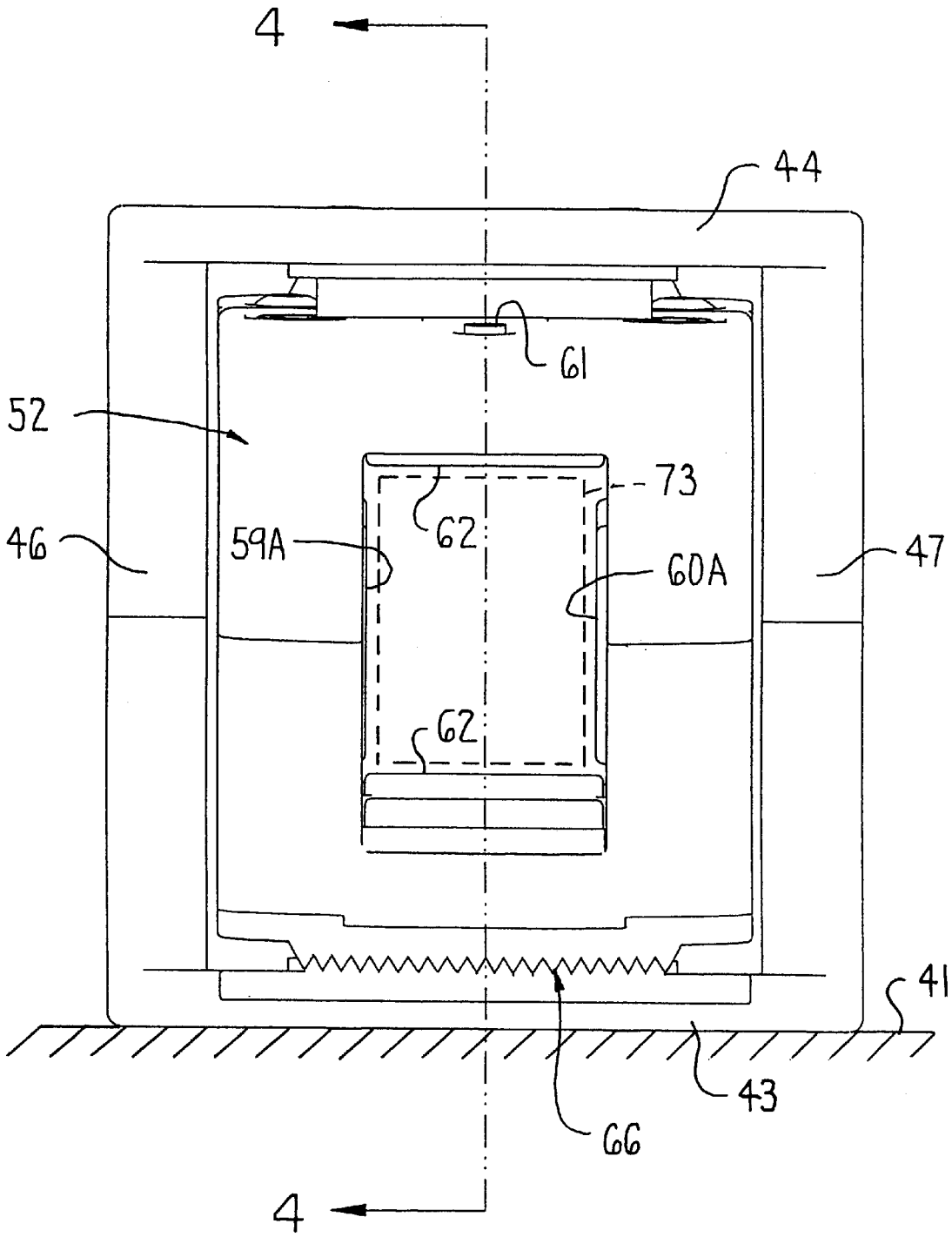
FIG. 7 is a left end view of FIG. 5.

A hollow sleeve 52, here a two piece construction, is provided inside the interior region 51 of the bearing housing 42. The hollow sleeve 52 includes a pair of coaxially aligned axle segments 53 and 54 received in the respective opening 48 and 49 in the bearing housing 42. An elastically yieldable sleeve 56 is provided between the axle segment 53 and the interior surface of the opening 48. A similar elastically yieldable sleeve 57 is oriented between the exterior surface of the axle segment 54 and the interior surface of the opening 49. If desired, a bushing 58 can be provided intermediate the interior surface of the openings 48 and 49 and the exterior surface of the elastically yieldable sleeves 56 and 57. The hollow sleeve 52 additionally includes an upper slide member 59 located within the interior surface of the hollow sleeve 52. Similarly, a lower slide member 60 is located within the hollow sleeve 52. In this particular embodiment, each of the upper and lower slide members 59 and 60 include inwardly projecting support surfaces 62. A pair of laterally spaced slide members 59A and 60A identical to the slide members 59 and 60 straddle the interior region 51 as shown in FIG. 7. The upper and lower slide members 59 and 60 as well as the slide members 59A and 60A are made of an elastically yieldable low friction material, such as a silicone impregnated acetal or a polyethylene material. During assembly, the spacing between the upper and lower slide members 59 and 60 can be independently adjusted by respective set screws 63 and 64 provided in the central region of the axle segments 53 and 54, respectively. The screws for adjusting the slide members 59A and 60A are similar to the screws 63 and 64 but are not shown.

The inward ends of the screws 63 and 64 bear against a leaf spring 55 anchored to the interior of the hollow sleeve by the fasteners 61. The leaf springs allow the ends of the slide members 59 and 60 remote from the securing fastener 61 to yield into a space 65 provided in the interior region of the hollow sleeve 52. Adjacent each of the spaces 65 is provided an elastomeric stop 70.

Figure 4:
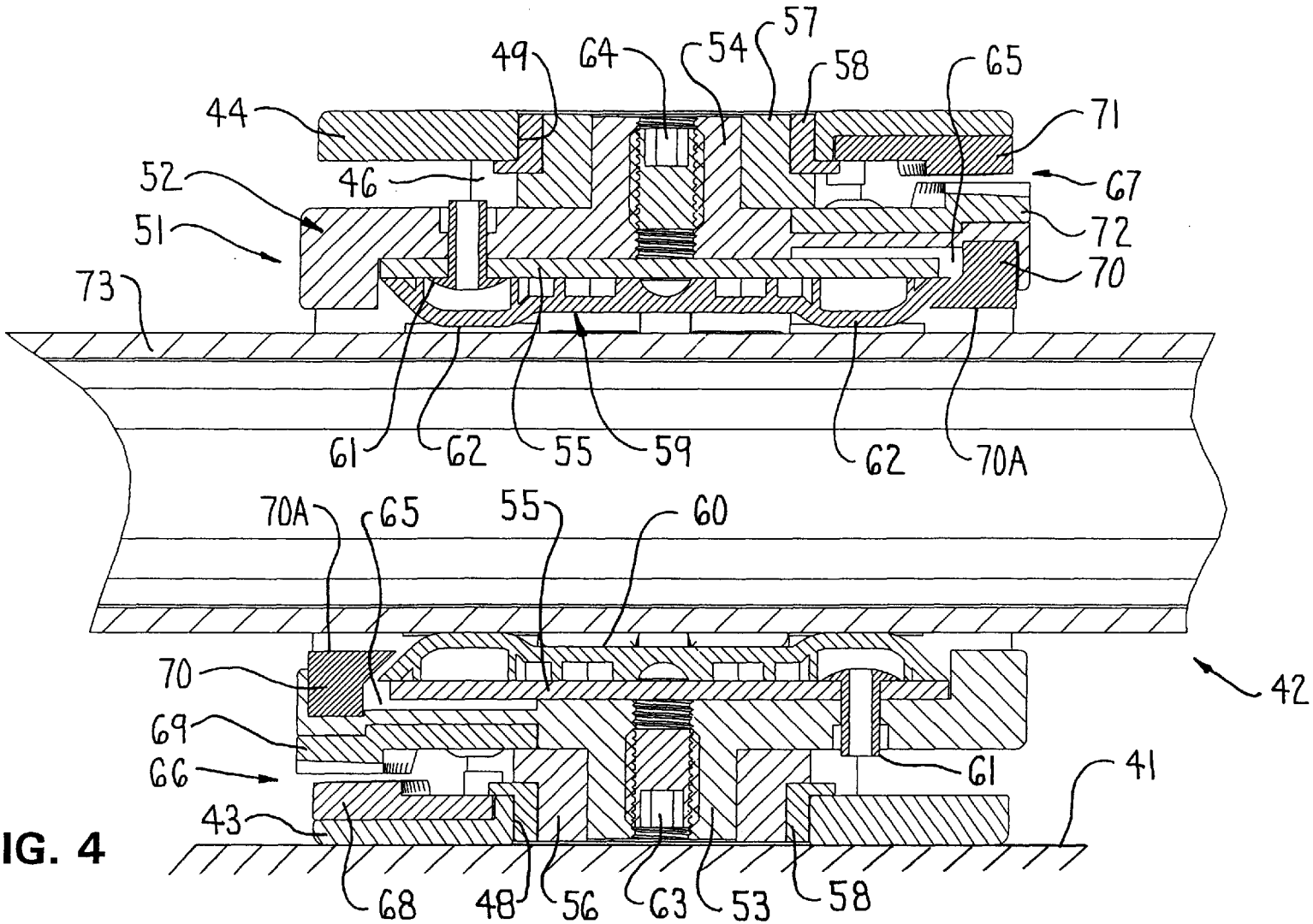
FIG. 4 is an enlarged cross sectional view of a fragment of FIG. 3 taken along the line 4—4 of FIG. 7.

An additional feature of the bearing housing 42 is the provision of two sets of meshable teeth 66 and 67 oriented between the hollow sleeve 52 and the respective base wall 43 and top wall 44. In this particular embodiment, the left side of FIG. 4 faces the foot end of the patient support 10 whereas the right side faces the head end of the patient support 10. The meshable teeth 66 arrangement is oriented on the lower left side of the hollow sleeve 52 and on the side of the bearing housing facing the foot section of the patient support. The base wall 43 has a toothed member 68 thereon where the teeth project upwardly therefrom. A further toothed segment 69 is secured to the underside of the hollow sleeve 52 and has a plurality of teeth projecting downwardly therefrom and into meshable engagement with the teeth on the toothed segment 68. As illustrated in FIG. 4, the two sets of teeth are initially vertically spaced from one another due to the elastically yieldable sleeves 56 and 57 urging the axle segments 53 and 54 to a centered location in the openings 48 and 49. Similarly, the meshable teeth 67 arrangement includes a toothed segment 71 fastened to the underside of the top wall 44 with the teeth thereof projecting downwardly. A further toothed segment 72 is fastened to the upper side of the hollow sleeve 52 and includes plural teeth thereon meshable with the teeth on the toothed segment 71. As is illustrated in FIG. 4, the teeth on the tooth segments 71 and 72 are initially vertically spaced from one another.

An elongate rod 73 is received through the interior of the hollow sleeve 52 and between the slide members 59, 59A, 60 and 60A so that the exterior surfaces of the elongate rod 73 will engage the support surfaces 62 and be slidingly guided thereby and for axial movement with respect thereto.

Figure 5:
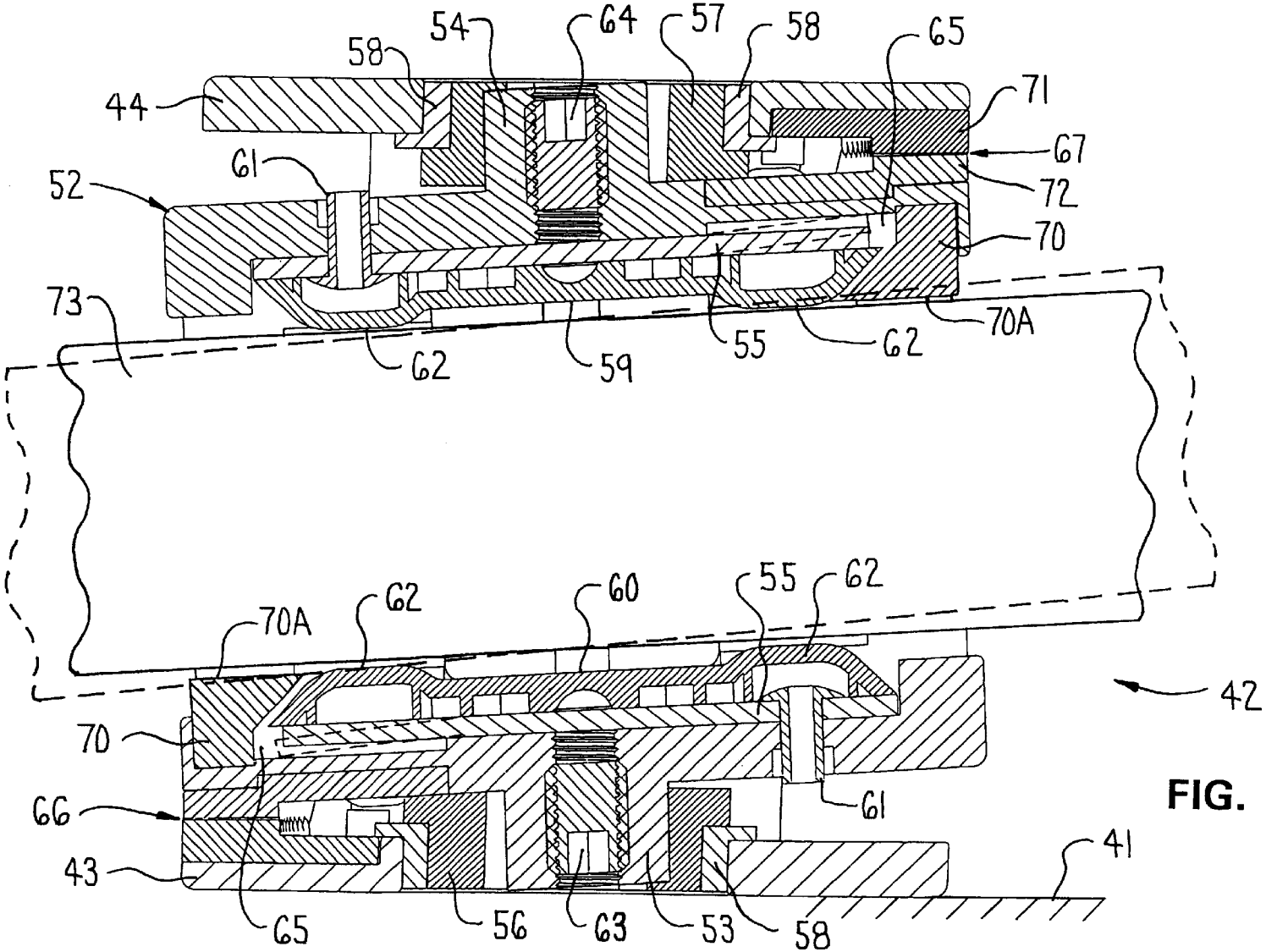
FIG. 5 is an enlarged fragment of FIG. 3, similar to FIG. 4, but with the elongate rod being tilted with respect to the horizontal.

As is illustrated in FIG. 5, the hollow sleeve 52 and the central axis thereof can tilt with respect to the axis of the interior region 51 of the bearing housing 42. This movement is accommodated by the elastic sleeves 56 and 57 yielding to such tilting motion as has been depicted in FIG. 5. It is to be noted that when the elongate rod 73 is tilted so that the left end thereof is lower than the right end illustrated in FIG. 5, the respective sets of teeth of the meshable teeth arrangements 66 and 67 move into engageable relationship. Further, the axle segments 53 and 54 on the hollow sleeve 52 facilitate movement of the hollow sleeve 52 and the elongate rod 73 housed therein about the respective axes of the axle segments. In this instance, the respective axes for the axle segments 53 and 54 are generally vertically aligned so that, and referring to FIG. 1, the foot rest mechanisms and the respective elongate rods 73 thereof are each capable of left and right movement.

Figure 3:
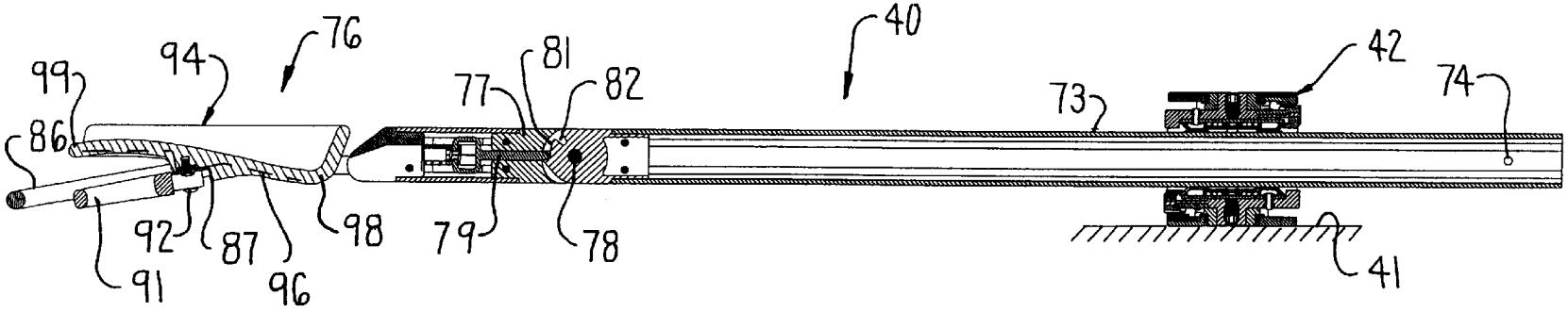
FIG. 3 is a longitudinally sectional view of a foot rest mechanism embodying the invention.
Figure 6:
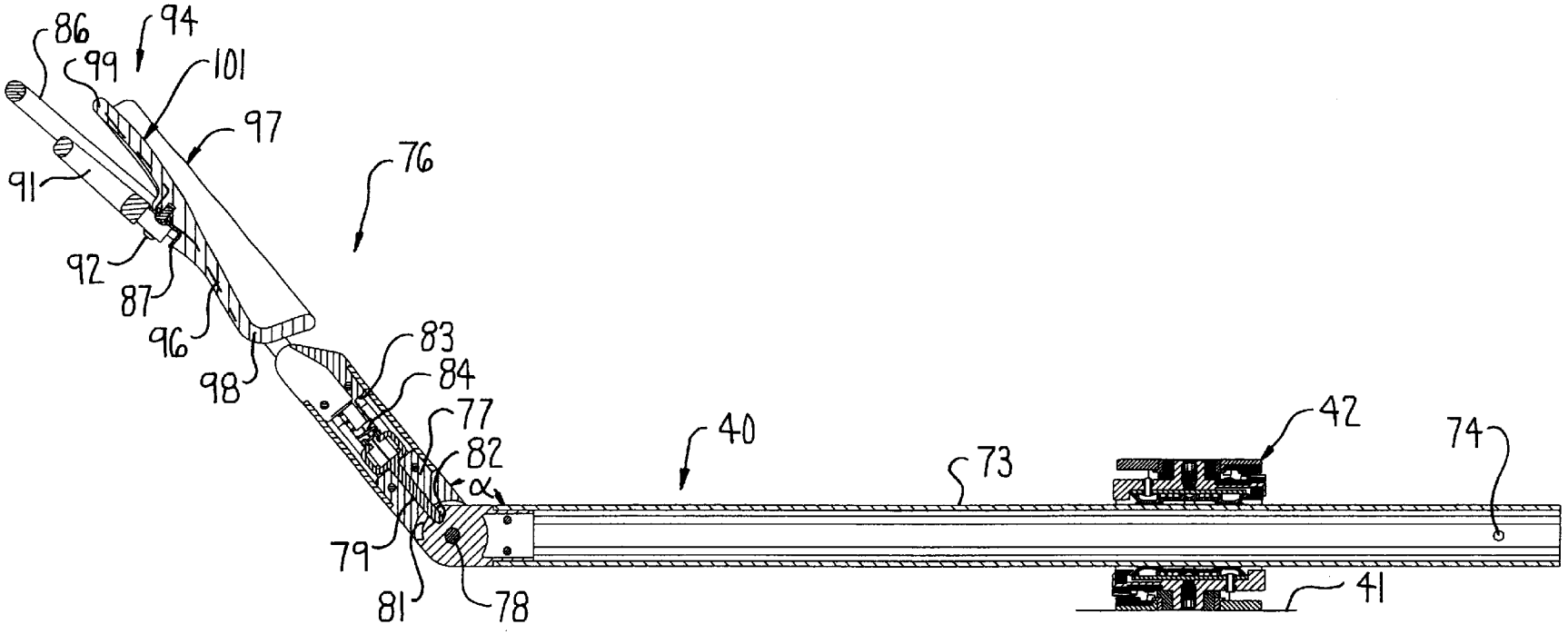
FIG. 6 is a view like FIG. 3, but with the foot support section being angled with respect to the elongate rod.

As is illustrated in FIGS. 3 and 6, the right end of the elongate rod 73 has a crosswise extending pin 74 therein which, while not specifically shown in the drawings, project laterally outwardly of the elongate rod 73 so as to engage the right side of the bearing housing so as to limit the extent of leftward movement of the elongate rod to the fully extended position. However, in order to facilitate an orienting of the position of the elongate rod 73 at any position between a fully stored position and a fully extended position, the leaf springs 55 and the associated slide members 59 and 60 undergo a further yielding when weight is applied to the end of the elongate rod 73 remote from the pin 74 to cause the upper and lower external surfaces of the elongate rod 73 to engage the surfaces 70A on the elastomeric stops 70 so that the elongate rod is frictionally restrained from longitudinal movement due to the aforesaid engagement as schematically depicted in broken lines in FIG. 5.

The end of the elongate rod remote from the pin 74 includes a foot support 76 for the foot of a patient supported on the patient support 10. The foot support 76 includes an elongate member 77 pivotally secured to the left end (FIGS. 3 and 6) of the elongate rod 73 and for movement about an axis of an axle pin 78. The elongate member 77 also includes thereon a latch in the form of a reciprocal pin 79, the distal end of which slides along an exterior end surface 81 of the elongate rod 73 in response to the elongate member 77 being pivoted about the axis of the axle pin 78. The end surface 81 terminates in a recess 82 and the distal end of the reciprocal pin 79 is received into the recess 82 when the elongate member has been pivoted to a limit position illustrated in FIG. 6. The end of the elongate member 77 remote from the surface 81 of the elongate rod 73 includes a spring abutment surface 83 supporting one end of a spring 84 thereat. The opposite end of the spring 84 rests against the head end of the reciprocal pin 79 so that the spring yieldably urges the distal end of the reciprocal pin 79 into sliding engagement with the surface 81 on the elongate rod 73 as well as into the recess 82 as illustrated in FIG. 6.

Figure 8:
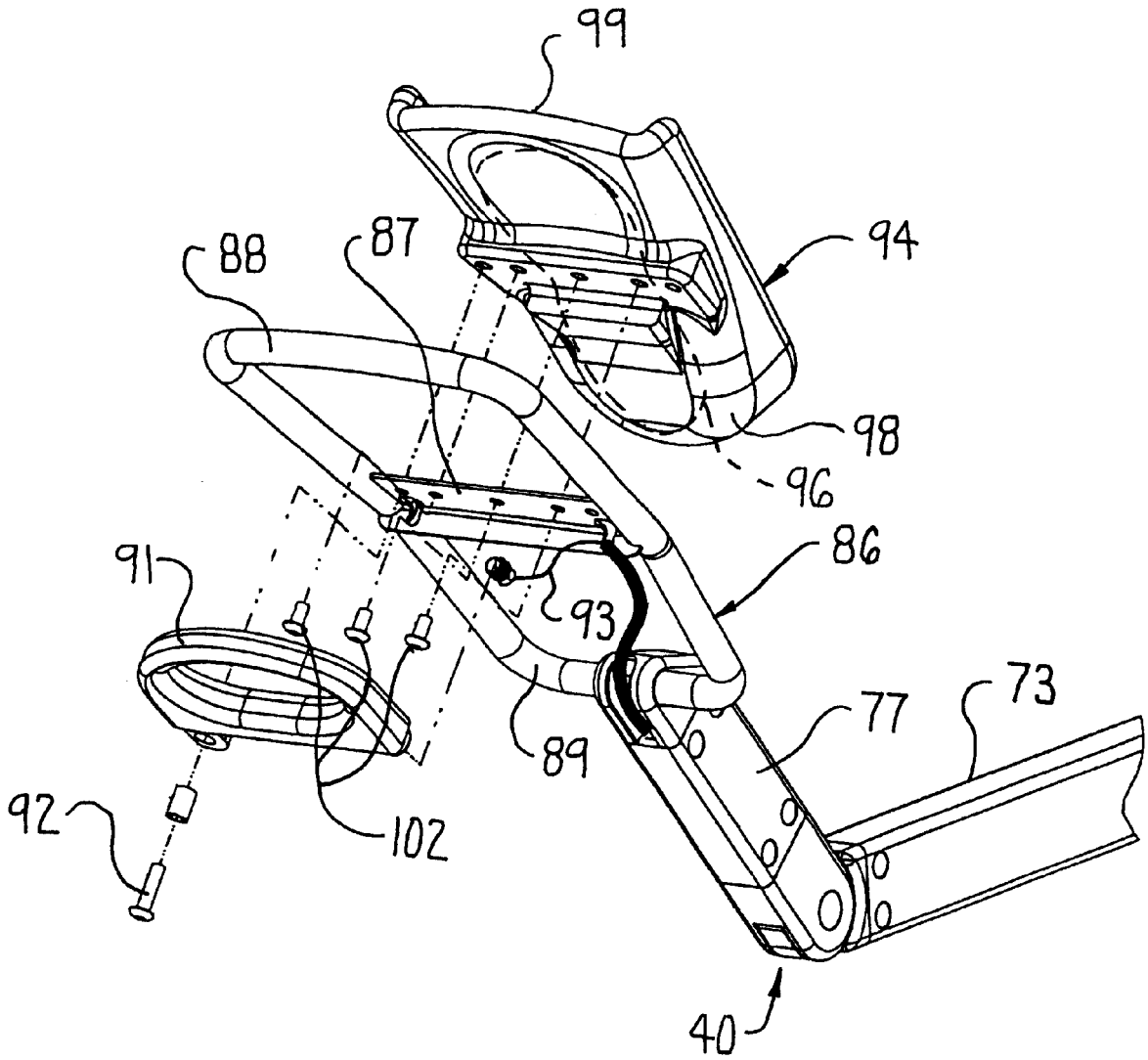
FIG. 8 is an exploded isometric view of the foot support.

The foot support 76 includes an annular frame 86 (see FIG. 8) fastened to the end of the elongate member 77 remote from the elongate rod 73. A cross member divides the annular frame 86 into a toe section 88 and a heel section 89. As is illustrated in FIG. 8, the heel section is proximal to the elongate member 77 whereas the toe section 88 is distal with respect thereto. A handle 91 is pivotally secured as by a pivot pin 92 to the cross member 87. One end of an elongate cable 93 is secured to the handle 91 at a location spaced from the location of the pivot pin 92. The opposite end of the cable 93 is secured to the proximal end of the reciprocal pin 79 so that upon a pivoting of the handle 91, the cable 93 will be placed into tension to compress the spring 84 and draw the reciprocal pin 79 out of the recess 82 when the footrest mechanism is in the FIG. 6 position.

The foot support 76 also includes a foot receiving tray 94 having a spring steel sheet core 96 encased in a synthetic resin material contoured platform 97 having a heel receiving section 98 and a toe receiving section 99 thereon. The heel receiving section 98 and the toe receiving section 99 are interconnected by a contoured surface 101 conforming generally to a bottom surface of a typical patient's foot. The lateral edges of the contoured surface 101 are turned upwardly so as to define the region into which is to be placed the patient's foot.

The foot receiving tray 94 is secured to the cross member 87 by a plurality of fasteners 102. The fasteners 102 operatively engage the spring steel sheet core 96 so as to securely hold the foot receiving tray 94 to the cross member 87. The elasticity of the synthetic resin material forming the contoured platform 97 facilitates the heel receiving section 98 and the toe receiving section 99 being able to flex with respect to the central part of the foot receiving tray 94 secured to the cross member 97 so as to accommodate flexure of the patient's foot.

The space between the handle 91 and the toe section 88 of the annular frame 86 defines a region into which the fingers of a hand can be placed so as to facilitate a grasping of the adjacent part of the annular frame.

The two foot rest mechanisms 40 are initially oriented in the position illustrated in FIG. 3, namely, wherein the foot support 76 is generally coplanar with the elongate rod 73 so that the entire assembly can be pushed beneath the mattress 16 and the mattress support 20 therefor so as to be generally out of the way. When the foot rest mechanisms 40 are needed, the attendant merely needs to grasp the component of the annular frame 86 most conveniently available and pull outwardly so as to effect a relative axial movement of the elongate rod 73 with respect to the bearing housing 42 and until the foot support 76 is in an appropriate position for the patient and limited by an engagement of the pin 74 with the bearing housing 42.

A relative movement between the elongate member 77 and the elongate rod 73 about the axis of the axle pin 78 will cause the foot support 76 to move relative to the elongate rod 73 from the FIG. 3 position to the FIG. 6 position whereat the foot support 76 forms an obtuse angle a with the elongate rod 73 and the distal end of the reciprocal pin 79 is urged by the spring 84 into the recess 82 to thereby lock the foot support 76 in the angled position illustrated in FIG. 6.

The lateral spacing between the foot rest mechanisms 40 can be adjusted by pivoting the elongate rods 73 toward and away from one another about the vertically upright axis defined by the axle segments 53 and 54. Once the longitudinal location and lateral spacing between the foot rest mechanisms 40 has been established, the patient can place the foot into the foot receiving tray 94 so that the weight of the patient's foot will cause the elongate rod 73 to tilt to the FIG. 5 position and to bring the respective meshable teeth 66 and 67 into engagement with one another and the exterior surfaces of the elongate rod 73 into engagement with the stops 70 to thereby fix the position of the elongate rods 73 with respect to one another and the patient support member 14.

Following a use of the foot rest mechanisms 40 and a removal of the weight of the patient's foot therefrom to cause the elongated rod 73 and hollow sleeve 52 to return to the FIG. 4 position, and assuming it is desirable to move the foot rest mechanisms 40 to a stowed position beneath the mattress 16 and the mattress support therefor, the attendant merely needs to manipulate the handle 91 so as to effect a tensioning of the cable 93 to effect a drawing of the reciprocal pin 79 out of the recess 82 against the urging of the spring 84. This will enable the foot support 76 to pivot about the axis of the axle pin 78 back to the FIG. 3 position so that the attendant can thereafter push the assembly including the elongate rod 73 rightwardly in FIG. 3 to re-stow the assembly beneath the mattress 16 and the mattress support therefor.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A patient support, comprising:

a frame having a patient supporting surface and pair of foot rest mechanisms thereon, each said foot rest mechanism including:

a bearing housing oriented on said frame;

a hollow sleeve and mounting means for swivelably mounting said hollow sleeve to said bearing housing and facilitating movement of said hollow sleeve side to side and up and down, said hollow sleeve having a guide passageway thereon;

an elongate rod slidingly received in said guide passageway and being movable with respect to said hollow sleeve longitudinally between a first retracted position and a second extended position with respect to said patient support surface;

a foot rest for a foot of a patient supported on said patient supporting surface, said foot rest being secured to a first end of said elongate rod, said foot rest having a manually engageable part thereon for facilitating the application of a selective manual force thereto for effecting at least one of said longitudinal movement, said side to side movement and said up and down movement of said foot rest; and locking means responsive solely to the weight applied by a patient's foot to said foot rest for fixing a selected position of said elongate rod and, consequently, said foot rest thereon relative to said patient support surface.

2. The patient support of claim 1, wherein said elongate rod includes a stop for limiting the distance of travel of said elongate rod relative to said hollow sleeve to a position corresponding to said second position.

3. The patient support of claim 2, wherein said stop is a pin having an axis orthogonally related to a longitudinal axis of said elongate rod and a length greater than a diameter of said guide passageway in said sleeve so that said pin engages a mutually adjacent end wall surface on said hollow sleeve when said elongate rod is at said second position.

4. The patient support of claim 1, wherein said mounting means includes an axle on said hollow sleeve and a pair of axially spaced openings in said bearing housing, opposite ends of said axle each being received in a hollow interior of a respective said opening so that said hollow sleeve is supported for at least one of said movements side to side and up and down.

5. The patient support of claim 4, wherein said axle is vertically upright oriented, and wherein said openings are vertically spaced so that said hollow sleeve is supported for said side to side movement.

6. The patient support of claim 5, wherein said mounting means additionally includes a hollow elastically yieldable sleeve received in each opening, wherein opposite ends of said axle are received in a hollow interior of a respective said hollow elastically yieldable sleeve so that said elastically yieldable sleeve will yield in response to at least one of said up and down movements.

7. The patient support of claim 6, wherein said guide passageway is lined with low friction material slide members for facilitating ease of sliding of said elongate rod engaged therewith longitudinally with respect to said hollow sleeve.

8. The patient support of claim 6, wherein said locking means includes at least one stop member frictionally engageable with said elongate rod in response to a yielding of said elastically yieldable sleeve to restrain longitudinal movement of said elongate rod relative to said hollow sleeve.

9. The patient support of claim 6, wherein said locking means includes plural opposed intermeshable teeth on said bearing housing and said hollow sleeve that are normally out of engagement with one another to facilitate said side to side movement of said foot rest means, said intermeshable teeth engaging one another in response to a yielding of said elastically yieldable sleeves to immobilize said side to side movement of said foot rest means.

10. The patient support of claim 9, wherein said locking means includes at least one stop member frictionally engageable with said elongate rod in response to a yielding of said elastically yieldable sleeve to restrain longitudinal movement of said elongate rod relative to said hollow sleeve.

11. The patient support of claim 1, wherein said foot rest includes an elongate member hingedly connected to said first end of said elongate rod for movement to first and second positions thereof, said first position being in general alignment with said elongate rod, said second position defining an angle with a longitudinal axis of said elongate rod, and a foot support mounted on and movable with said member.

12. The patient support of claim 11, wherein said angle is an obtuse angle.

13. The patient support of claim 11, wherein said elongate member includes a latch mechanism for releasably locking said elongate member in at least said second position.

14. The patient support of claim 13, wherein said elongate member further includes a latch release handle movably supported on said elongate member and a connection member interconnecting said latch release handle to said latch mechanism.

15. The patient support of claim 14, wherein said latch mechanism includes a recess on said first end of said elongate rod and a latch member interconnected by said connection member to said latch release handle, a spring member for continually urging said latch member toward and into said recess, activation of said latch release handle effecting a removal of said latch member from said recess against a force of said spring member.

16. The patient support of claim 1, wherein said foot rest includes an elongate member to which is secured a foot receiving tray, and support means for supporting said tray for movement relative to said elongate member to accommodate flexure of the patient's foot.

17. The patient support of claim 16, wherein said foot receiving tray includes a spring steel core encased in a contoured platform having a heel receiving section and a toe receiving section interconnected by a contoured surface conforming generally to a bottom surface of a typical patient's foot, said spring steel core being secured to said elongate member, said spring steel flexing to accommodate flexure of the patient's foot.

18. The patient support of claim 17, wherein said securement of said spring steel core to said elongate member is oriented midlength of said contoured surface interconnecting said toe and heel sections so as to facilitate a rocking of said foot receiving tray about an axis parallel to and transverse of a longitudinal axis of said foot receiving tray.

19. The patient support of claim 16, wherein said manually engageable part is provided on said elongate member and is an integral part thereof.

20. The patient support of claim 1, wherein said frame and said patient supporting surface thereon includes a drop leaf foot section straddled by said pair of foot rest mechanisms when said pair of foot rest mechanisms are in said second extended positions thereof.

21. The patient support of claim 20, wherein said frame includes a base and a fluid operated jack for interconnecting said base and said frame, said fluid operated jack being configured for raising and lowering said patient supporting surface relative to said base, said drop leaf foot section being movable between a first generally horizontally aligned position and a second generally vertically aligned position, said drop leaf foot section including a pivotally supported cam mechanism that is configured to engage a component on said base in response to a lowering of said frame and said drop leaf section relative to said base and be pivoted thereby and only when said drop leaf foot section is in said second position, said cam mechanism, when pivoted, causing said drop leaf foot section to be urged toward said first position thereof to thereby prevent engagement of a foot end of said drop leaf foot section with a surface upon which said patient support is resting.

22. The patient support of claim 21, wherein said component is an end of said jack, wherein said cam mechanism is configured to engage an end of said jack when a rod of said jack is nearing a fully retracted position, engagement of said cam mechanism with said end of said jack while said rod is moving toward said fully retracted position thereof causing said cam mechanism and said drop leaf foot section to pivot.

23. The patient support of claim 22, wherein said cam mechanism is also configured to engage said rod of said jack when said rod is nearing a fully extended position thereof from said jack to thereby limit the extent of movement of said cam mechanism and said drop leaf foot section.

24. A foot support, comprising:

an annular frame;

a cross member connected to said annular frame to thereby divide said annular frame into a toe section and a heel section; and a foot receiving tray secured to said cross member, said foot receiving tray having a spring steel core encased in a contoured platform having a heel receiving section and a toe receiving section interconnected by a contoured surface, said spring steel core and said contoured platform being secured to said cross member and configured to flex to accommodate flexure of the patient's foot.

25. The foot support according to claim 24, wherein said securement of said spring steel core and said contoured platform to said cross member is oriented midlength of said contoured surface so as to facilitate a rocking of said foot receiving tray about an axis parallel to and transverse of a longitudinal axis of said foot receiving tray.

26. A patient support, comprising:

a frame having a patient supporting surface;

a base and a fluid operated jack for interconnecting said base and said frame, said fluid operated jack being configured for raising and lowering said frame relative to said base;

a drop leaf foot section pivotally supported on said frame for movement between a first generally horizontally aligned position and a second vertically aligned position; and a cam mechanism oriented between said drop leaf foot section and said base for pivoting said drop leaf foot section, when in said second position thereof, in response to a vertical downward movement of said frame so as to prevent contact of said drop leaf foot section with a surface upon which said patient support is resting.

* * * * *